US007390144B2

(12) United States Patent
Fedrick

(10) Patent No.: US 7,390,144 B2
(45) Date of Patent: Jun. 24, 2008

(54) PRE-CAST/PRE-STRESSED CONCRETE AND STEEL PILE AND METHOD FOR INSTALLATION

(75) Inventor: Ronald M. Fedrick, Petaluma, CA (US)

(73) Assignee: Nova Group Inc., Napa, CA (US)

( * ) Notice: Subject to any disclaimer, the term of this patent is extended or adjusted under 35 U.S.C. 154(b) by 56 days.

(21) Appl. No.: 11/345,802

(22) Filed: Feb. 2, 2006

(65) Prior Publication Data

US 2007/0177948 A1 Aug. 2, 2007

(51) Int. Cl.
*E02D 5/30* (2006.01)
*E02D 5/50* (2006.01)

(52) U.S. Cl. ..... 405/233; 405/240; 405/249; 405/257

(58) Field of Classification Search ..... 405/232, 405/233, 239, 240, 249, 257
See application file for complete search history.

(56) References Cited

U.S. PATENT DOCUMENTS 3,436,921 A * 4/1969 Isaacs et al. ..... 405/249
5,771,518 A 6/1998 Roberts
6,094,873 A 8/2000 Hoffman et al.
6,382,878 B1 * 5/2002 Yang ..... 405/232
6,425,713 B2 7/2002 Fox et al.
6,595,303 B2 7/2003 Noe et al.
6,688,815 B2 2/2004 Fox et al.
7,104,732 B2 * 9/2006 Mignacca ..... 405/235

OTHER PUBLICATIONS

British Columbia, Ministry of Water, Land and Air Protection, "Britannia Mine Remediation 4100 Level Plug Safety Investigation Plan", pp. 1-12, Dec. 2001.
U.S. Army Corps of Engineers' Unified Facilities Guide Specifications, dated Apr. 2006.
A Super Jaws® Under Reaming Drill Bit, and a Challenger hammer 2, both of which are manufactured by Numa Corporation.

* cited by examiner

*Primary Examiner*—Tara L. Mayo
(74) *Attorney, Agent, or Firm*—Nixon Peabody LLP

(57) ABSTRACT

A method for installing a pre-cast/pre-stressed concrete and steel pile used in the construction of pile foundations and the resulting installed pile that has its distal end anchored to bedrock is disclosed. After the pile is located on bedrock, a first hole is drilled into bedrock that is of sufficient depth to accommodate a lower portion of the steel pipe that extends below the concrete pile and contains a plurality of orifices. A second hole is drilled into bedrock that is below and concentric to the first hole and has a diameter than that is usually less than that of the first hole. The second hole forms an anchoring socket to accommodate an anchoring anchor. Grout is injected into the steel pile and anchoring socket until the grout fills the voids in the interior of the steel pipe. Grout also seeps through the orifices in the lower end of said steel pipe and fills the second hole, and an annular space between the outer circumference of the steel pipe and the walls of the first hole.

20 Claims, 7 Drawing Sheets

PRE-CAST/PRE-STRESSED CONCRETE AND STEEL PILE AND METHOD FOR INSTALLATION

FIELD OF THE INVENTION

The present invention relates to concrete piles used in the construction of pile foundations into bedrock and methods of installing such piles. More particularly the present invention relates to pre-cast, pre-stressed concrete and steel piles that are anchored to bedrock.

BACKGROUND OF THE INVENTION

Various methods are known for using steel tubes or pipes as part of a pier support system in a soil matrix and removing the soil matrix with drills or augers placed within the steel tubes; see, e.g., U.S. Pat. Nos. 6,425,713 and 6,688,815. It is also known to use steel tubes in pier support systems for modular residential or commercial buildings using rock anchors to anchor the pier support systems to solid bedrock; see, e.g., U.S. Pat. No. 6,094,873.

U.S. Pat. No. 5,771,518 is directed to a steel-reinforced, pre-cast concrete pier structure in which a uniform diameter hole is drilled to a sufficient depth into the earth and at a sufficient diameter to more than accommodate the outer diameter of each of the main pier elements. The main pier elements are defined by a central steel pipe around which is formed a tubular, steel-reinforced, pre-cast concrete section. After the pier element is lowered into the earth-drilled hole, loose aggregate material is dumped into the annular space between the outer surface of the pier element and in the central steel pipe interior. A quick-setting grout is injected through this central pipe down through the aggregate to the bottom of the pipe and up through the aggregate and fills the entire annular space occupied by the aggregate.

While it may be practical to drill a uniform diameter hole into the earth to a depth to accommodate the outer diameter of the pre-cast concrete pile as described in the '518 patent, there is a need for an improved method of installation of a pile in cases where drilling is done into bedrock usually at the bottom of a body of water, e.g., under a seabed or an ocean floor.

SUMMARY OF THE INVENTION

The present invention solves the above-identified problem of installing a pre-cast, pre-stressed concrete and steel pile in bedrock. During the pre-casting operation, the concrete pile is reinforced with a central steel pipe, which has a lower portion extending below the concrete pile. A plurality of orifices is distributed over the entire cylindrical area of the portion of the steel pipe that extends below the distal end of the concrete pile.

In the first step of one embodiment of method of the present invention, the pre-cast, pre-stressed concrete pile is located on bedrock. A drilling tool is lowered through the entire length of the steel pipe and a first hole is drilled into the bedrock during the next step of the method. The first hole is of sufficient depth to accommodate the lower portion of the steel pipe. The diameter of the first hole is greater than the outer circumference of the steel pipe to allow the steel pipe to move down as the first hole is being drilled from within the pipe during this drilling step. The diameter of the first hole is drilled not only to have a diameter slightly greater than the diameter of the steel pipe, but also to form a substantially uniform annular space between the outer circumference of the lower portion of the steel pipe and the drilled wall of the first hole in the bedrock.

The drilling tool while still within the steel pipe is then used to drill a second hole that is below and concentric with the first hole and has a smaller diameter than that of the first hole to form an anchoring socket to accommodate an anchor. The drilling tool is removed from the steel pipe and the anchor is extended through substantially the entire length of the steel pipe and into the anchoring socket. A grout injection pipe is lowered into the steel pipe and grout is injected under pressure until the grout fills the interior of the second hole and interior of the steel pipe. In addition, the grout seeps through the orifices in the lower end of the steel pipe to fill this uniform annular space. The grout injection pipe is removed from the steel pipe and the grout is allowed to harden.

In another embodiment of the method of the present invention, the foregoing steps are carried out except that after the anchor has been lowered so that its distal end is adjacent the bottom of the second hole, an inflatable bladder, preferably having a shape similar to that of a doughnut, is lowered along the anchor within the steel pipe. The doughnut-shaped bladder is positioned so that it is part way between the proximate and distal ends of the steel pipe. The grout injection pipe is then lowered through the "doughnut hole" of the bladder and the bladder is inflated to provide stability of the injection pipe and to allow the grout to be injected under pressure during the step of injecting grout into the pipe.

In still another embodiment of the method of the present invention, the anchor is a rock anchor comprising a high strength rod extending through the entire length of the steel pipe and through its distal ends to a position adjacent the bottom of the second hole of the anchoring socket. Preferably, a bearing plate is attached to the distal end of the anchoring rod.

The steel pipe-reinforced concrete pile of the present invention that is installed in accordance with the method of the present invention includes:

a) the pre-stressed concrete pile that has its distal end located on bedrock;

b) the steel pipe pre-cast along the same longitudinal axis as the concrete pile that has a lower portion containing a plurality of orifices and extending below the distal end of the concrete pile and into the first hole drilled into bedrock to leave an annular space between the outer circumference of the steel pipe and the walls of first hole in the bedrock;

c) the anchor that extends through the entire length of the steel pipe, through its distal end and into the second hole drilled into the bedrock and has a diameter less than the diameter of the first hole; and d) grout that fills the annular spaces between the rock anchor and the interior walls of the steel pipe, the rock anchor and the walls of the second hole, and the outer circumference of the steel pipe and the bedrock.

One of the advantages of the present invention is to provide an improved pile structure to support foundation structures and the like.

A further understanding of the invention can be had from the detailed discussion of the specific embodiments below. For purposes of clarity, this discussion refers to specific equipment and method steps. However, other equipment and variations of these specific method steps may be used. It is therefore intended that the invention not be limited by the following discussion of specific embodiments.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Figure 1:
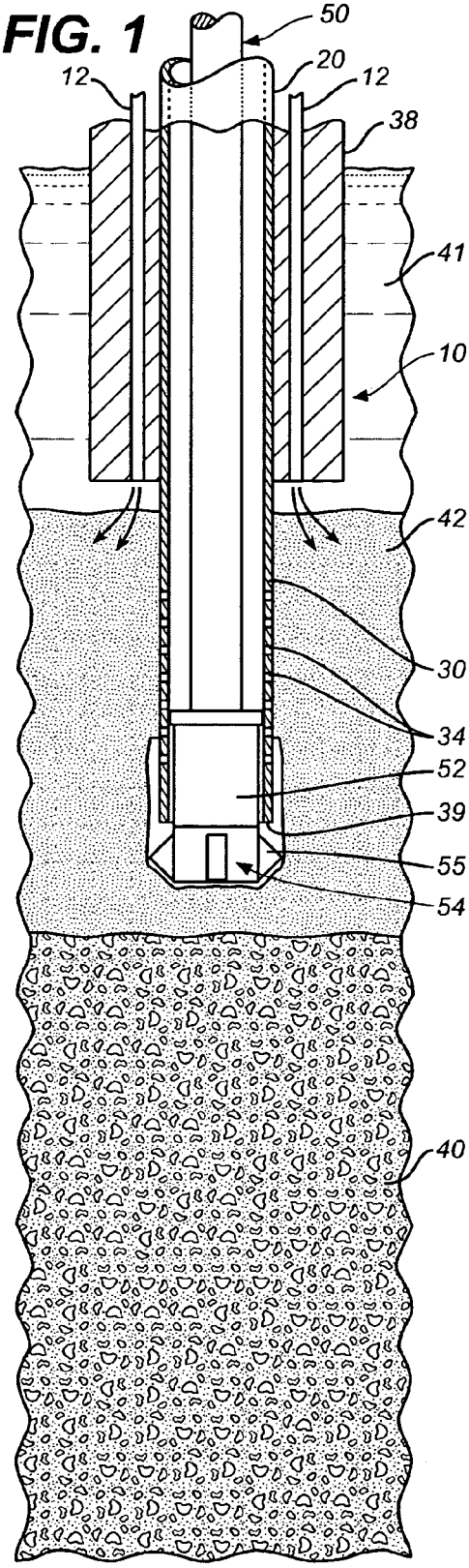
FIG. 1 is a schematic cross-sectional view of the lower section of a steel pipe-reinforced concrete pile after a pile locating step of an embodiment of the method of the present invention.

Reference symbols or names are used in the figures to indicate certain components, aspects or features shown therein, with reference symbols common to more than one figure indicating like components, aspects or features shown therein.

DETAILED DESCRIPTION OF THE INVENTION

To facilitate its description, the invention is described below in terms of specific embodiments, and with reference to the figures.

FIGS. 1-5 are illustrative of the sequential steps of the one embodiment of the method of the present invention described in detail below. The product resulting from the method of the present invention is an installed steel pipe-reinforced concrete pile 10 having air or water jet tubes 12 extending therethrough and reinforced with internal steel pipe 20 positioned along longitudinal axis 22 (shown in FIG. 9A) and is partially shown in FIG. 8. The lower portion 30 of steel pipe 20 extends below pile 10 and has a plurality of grout holes 34 that are preferably uniformly drilled around the lower approximately one-third of the cylindrical area of lower portion 30 of pipe 20.

FIGS. 1-8 only show the lower section 38 of concrete pile 10 to illustrate the steps of various embodiments of the method of the present invention of firmly cementing lower portion 30 of pipe 20 in bedrock 40.

Figure 2:
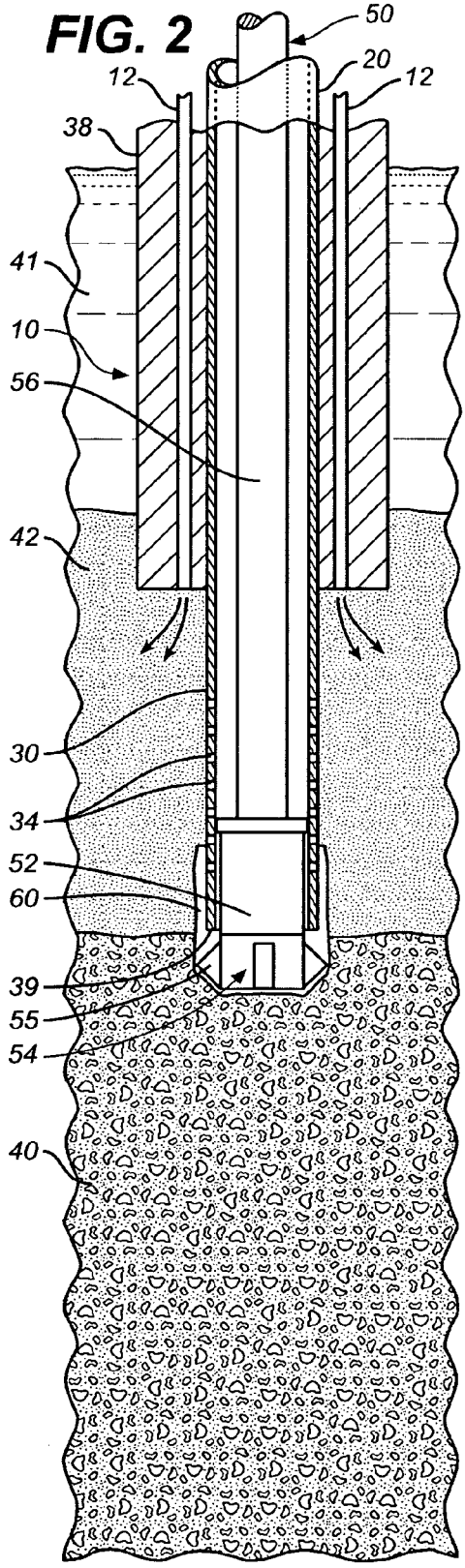
FIG. 2 is a schematic cross-sectional view of the lower section of a steel pipe-reinforced concrete pile during a first drilling step of an embodiment of the method of the present invention.
Figure 3:
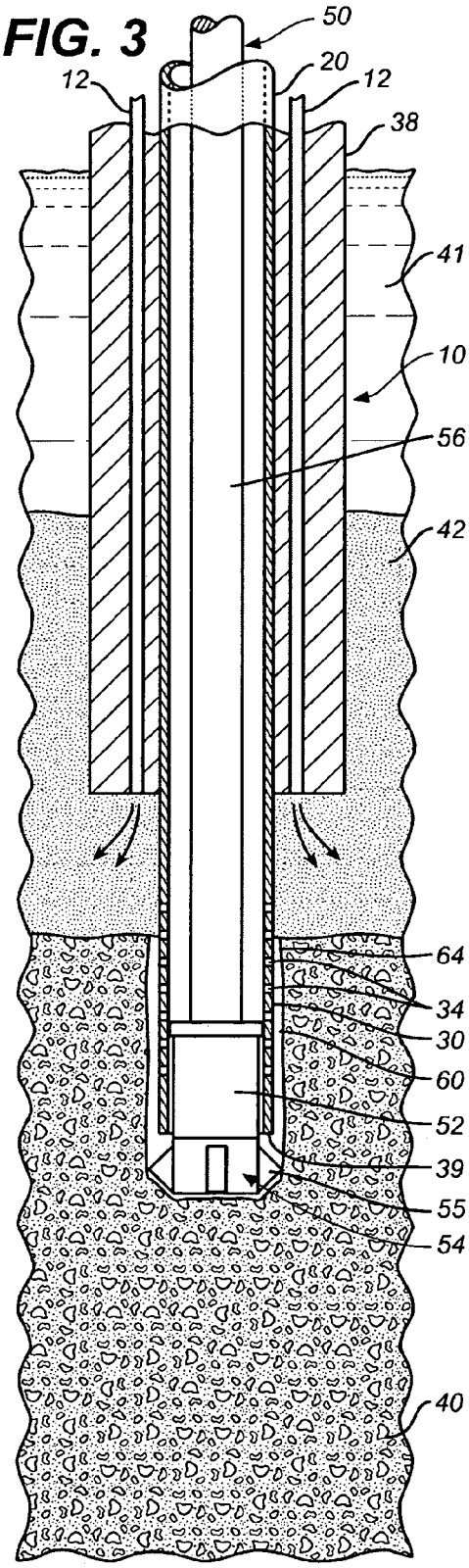
FIG. 3 is a schematic cross-sectional view of the lower section of the steel pipe-reinforced concrete pile after the first drilling step of an embodiment of the method of the present invention.

FIG. 1 shows lower section 38 after special lifting apparatus such as a crane, or other piece of construction equipment is used to lower concrete pile 10 through a body of water 41 until lower portion 30 of steel pipe 20 is embedded in sand, soil or other composition 42 to complete the first step. Usually the combined weight of steel-pipe reinforced pile 10 is sufficient to cause steel pipe 20 to sink into composition 42 and to have the lower end 39 of pipe 20 come to rest on bedrock 40 after this pile locating step of the present method. Pressurized air is passed through air jet tubes 12 to loosen composition 42 and assist in lowering pipe 10 as shown in FIGS. 1-3. In some installations, lower end 39 of portion 30 is above bedrock 40 after the concrete pile is lowered through water 41 as shown in FIG. 1. In either case, after rotary drilling equipment 50 is lowered through pipe 20 so that hammer 52 and drill bit 54 having wings 55 are adjacent bedrock 40, the drilling step begins in either bedrock 40 or composition 42 above bedrock 40.

FIG. 2 shows lower section 38 during the first hole drilling step in which air driven drilling equipment 50 is used to drill first hole 60 into bedrock 40 using retractable drill bit 54 with wings 55 at the end of drill stem 56. The diameter of first hole 60 is slightly greater than the outside diameter of pipe 20 to form annular space 64 (shown in FIGS. 3-4) between the outer circumference of pipe 20 and the bedrock walls of first hole 60 that is later filled in with grout. Preferably the diameter of first hole 60 is at least about 6 inches and more preferably in the range of about 6 to 30 inches. The preferred length of first hole 60 is at least about 5 feet and more preferably in the range of about 5 to about 25 feet.

A suitable type of drilling equipment 50 for the drilling operations of the present invention is one that has the feature that when drill bit 54 is lowered in place adjacent bedrock 40, wings 55 furl out from drill bit 54 as shown in FIGS. 1-3 to permit the drilling of first hole 60 with the desired diameter slightly greater than the outer diameter of pipe 20. Hammer 52 is pneumatically operated at air pressures in the range of about 100 to about 300 psi. The drilling operation can also be done by using steerable drilling equipment 50 positioning drill bit 54 in various offset positions to drill holes larger than the inner diameter of pipe 20 by techniques well known in the prior art; see, e.g., U.S. Pat. No. 6,595,303 for a description of this type of drilling operation.

FIG. 3 shows lower section 38 of steel-pipe reinforced concrete pile 10 after first hole 60 has been drilled to the desired depth at the completion of the first drilling step. After this step, wings 65 can be retracted back into bit 54. If desired, this will allow hammer 52 and bit 54 to be pulled back up via drill stem 56 after the drilling of first hole 60 to change the drill bit for the next step.

Figure 4:
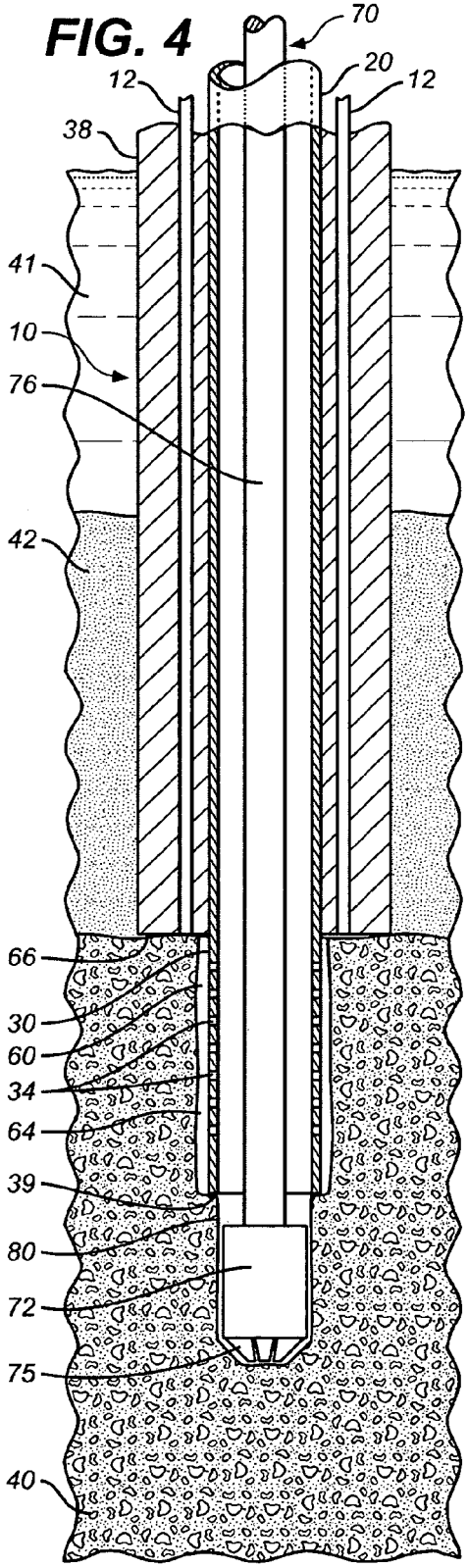
FIG. 4 is a schematic cross-sectional view after a second drilling step of an embodiment of the method of the present invention.

FIG. 4 shows shoulder 66 of concrete pile 10 resting on surface of bedrock 40 and end 39 is shown adjacent the bottom of first hole 60. During the second hole drilling step, drilling equipment 50 is replaced with drilling equipment 70 of drilling stem 76 and drill bit 75 to drill second hole 80 having a smaller diameter than that of the first hole. Preferably the diameter of second hole 80 is at least about 3 inches and more preferably in the range of about 3 to 24 inches. Second hole 80 is preferably drilled to a depth of at least about 5 feet, and still more preferably to a depth within a range of about 5 to about 25 feet.

Figure 5:
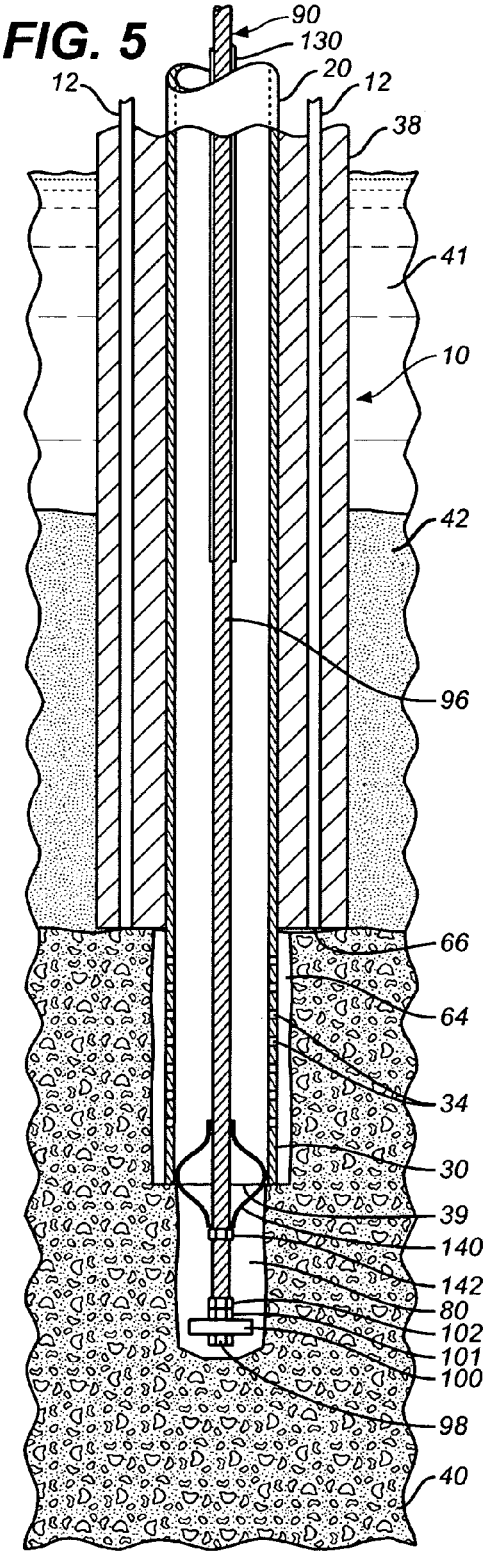
FIG. 5 shows a schematic cross-sectional view of the lower section of the steel pipe-reinforced concrete pile after an anchor placement step of an embodiment of the method of the present invention.

Referring to FIG. 5, an anchoring means 90 has been lowered into place within concrete pile 10 so that the anchor is positioned along the entire length of pipe 20 and through the combined depths of first hole 60 and second hole 80. FIG. 5 shows section 30 after the completion of the next step of the preferred embodiment. In this example, a suitable anchoring means is a rock anchor having a reinforcing steel tension rod 96 and a bearing plate 100 held in place by anchoring nuts 98, 101 and 102. The U.S. Army Corps of Engineers' Unified Facilities Guide Specifications, dated December 2001, contains details of the installation of rock anchors.

Figure 6:
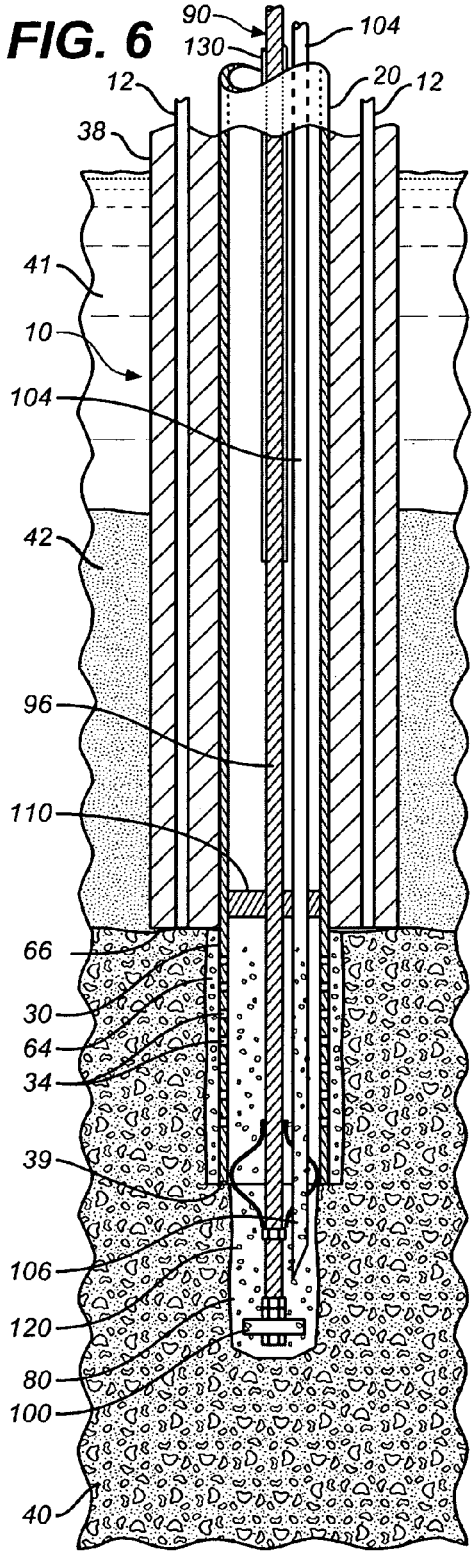
FIGS. 6 and 7 show schematic cross-sectional views of the lower section of the steel pipe-reinforced concrete pile during the grout injecting step of another embodiment of the method of the present invention.

FIG. 6 shows lower section 38 during the initial phase of the injection step according to one embodiment of the present method. In this embodiment, grout injection pipe 104 has been lowered within pipe 20 so that its injection pipe outlet 106 is adjacent bearing plate 100. An inflatable pneumatic bladder 110 is installed in lower portion 30 as shown. Bladder 110 is then inflated to place grout 120 under pressure during the injection step. A suitable injection pipe is a standard tremie pipe having a 2 inch nominal diameter. Prior to the injection of grout 120, compressed air is used to flush any loose drilling materials from hole 80 and annular space 64. Grout 120 is preferably injected at a pressure in the range of about 80 to about 120 psi, and more preferably at a pressure of about 100 psi. Additional details well known in the art regarding installing pneumatic bladders prior to injection of grout can be found in Britannia Mine Remediation 4100 Level Plug Safety Investigation Plan, dated December, 2001. At the end of the initial phase of the injection step, grout 120 has filled anchoring socket 80, the annular spaces between tensioning rod 96 and the inner wall of pipe 20 in lower section 30, and annular space 64, as shown in FIG. 6.

FIGS. 5-6 also show an upper section of rod 96 encased in a plastic pipe 130, preferably polyvinyl chloride pipe to prevent the outer surface of rod 96 from contacting grout 120 during the grout injection step. In addition, a plastic centering element 140 is tightened around the lower section of rod. 96 within first hole 60 and is attached by nut 142 to the section of rod 96 within second hole 80. The portion of plastic centralizer 140 between first hole 60 and second hole 80 is bulged to fill the opening of hole 80 to provide centering of rod 96 during the grout injection step.

Figure 7:
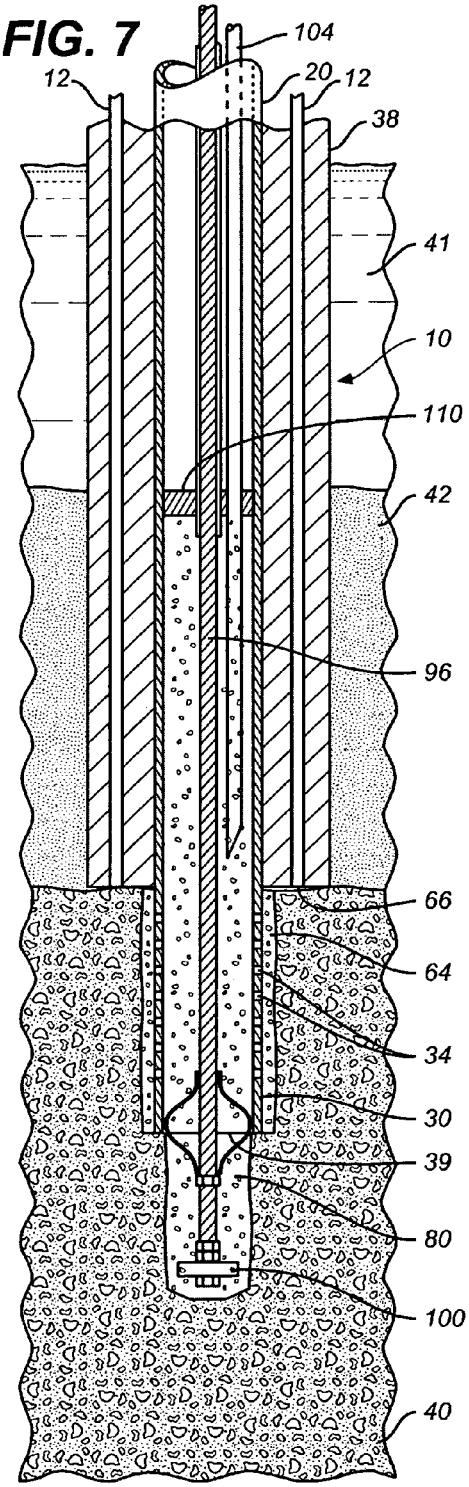

FIG. 7 shows lower section 38 during the next phase of the injection step in which pneumatic bladder 110 and the end of injection pipe 104 have been moved above lower section 30. Grout 120 is then injected into the void spaces in the interior of steel pipe 20 below bladder 110. The foregoing is repeated until all of the void spaces in the entire interior of steel pipe 20 are filled with grout 120 and bladder 110 and injection pipe 104 are removed.

Figure 8:
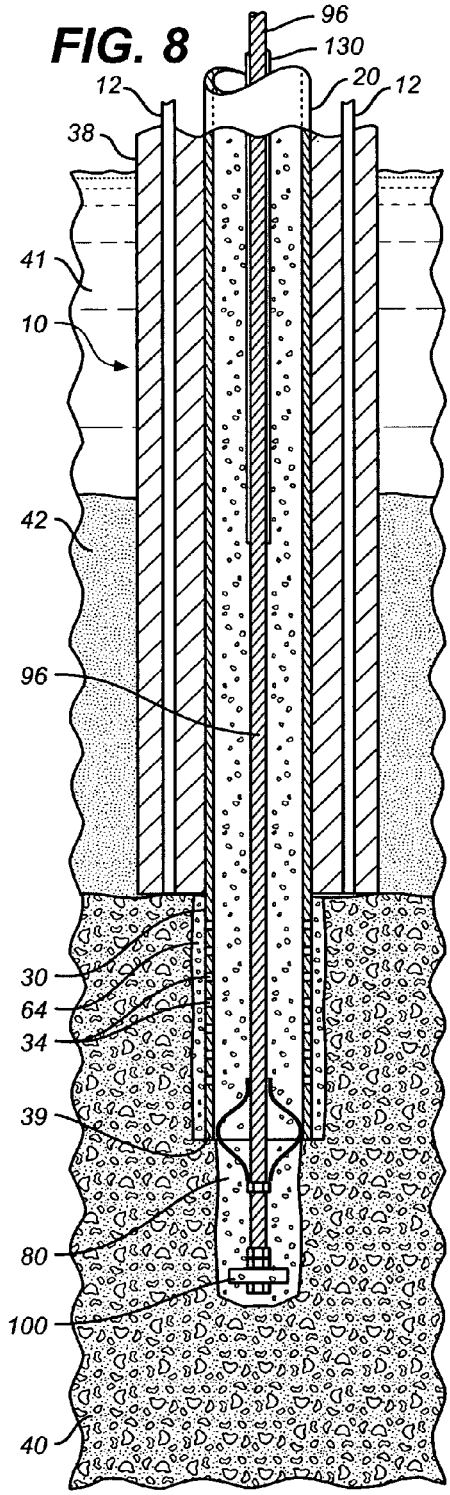
FIG. 8 is a schematic cross-sectional view showing an installed steel pipe-reinforced concrete pile according to one embodiment of the present invention.

FIG. 8 shows lower portion 30 of the installed steel pipe-reinforced concrete pile 10 of the present invention after grout 120 has hardened with plastic pipe 130 and centering element 140 remaining in place.

An example of the preferred embodiment of the present invention that follows illustrates that after a concrete pile had been installed using the method of the present invention, the pipe was stress tested to a high percentage of its rated capacity. The example is for illustrative purposes only and is not meant to limit the scope of the claims in any way.

EXAMPLE

Figure 9A:
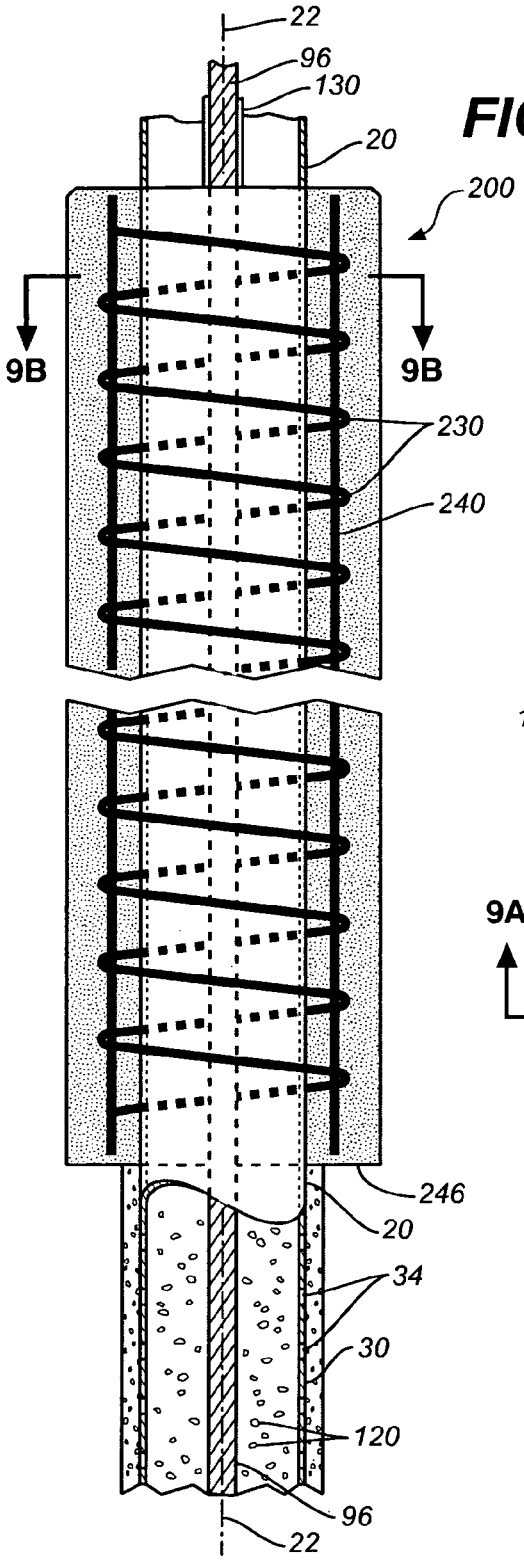
FIG. 9A is a longitudinal view, partially in cross-section, to reveal the contents of the internal structure of the installed steel pipe-reinforced concrete pile according to another embodiment of the present invention.
Figure 9B:
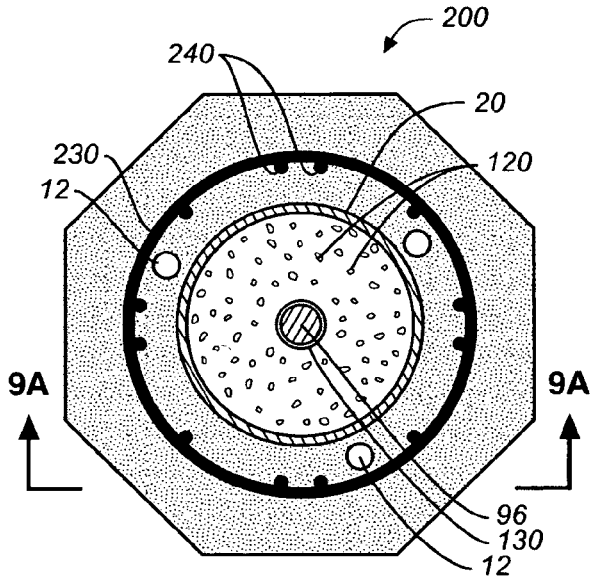
FIG. 9B is a cross-sectional end view of the installed steel pipe reinforced concrete pile shown in FIG. 9A taken along line 9B-9B.

FIGS. 9A and 9B show an octagonal concrete pile after installation in accordance with this Example. Octagonal concrete piles were found to be preferred for the pile foundations subjected to the environmental conditions of this Example. Specifically, a 24 inch octagonal pre-stressed concrete pile 200 having a 12 inch nominal diameter carbon steel pipe 20 was first pre-cast along longitudinal axis 22. Steel prestressed strand 240 was wrapped with epoxy coated steel rebar 230 before being pre-cast with steel pipe 20 in concrete. Approximately 65 grout holes 34 were uniformly drilled over the entire cylindrical area of lower portion 30 of pipe 20 that extends below shoulder 246 of concrete pile 200. The holes were about ⅛ inch in diameter to allow the grout to flow therethrough.

The remaining description of this Example refers to the steps of the method of the present invention generally as shown in FIGS. 1-7. Octagonal concrete pipe 200 was lowered through about 8 to about 10 feet of moist sand and sand overburden of seabed 42 with the assistance of pressurized air that was passed through air jets 12 until distal end 39 of steel pipe 20 struck bedrock 40.

A super Jaws® Under Reaming Bit 65, Number VT 315, and a Challenger hammer 52, both of which are manufactured by Numa Corporation, were lowered through pipe 20 and were used to drill an approximately 13-⅜ inch diameter pile rock first socket 60 to a depth of 16 feet into bedrock 40. Annular space 64 had a thickness of about ⅜ inch. Bit 54 was removed from the 0.75 inch drill string 56 and replaced with a drill equipment 70 having a 10 inch bit 75. Drill bit 75 was used to drill a 10 inch diameter rock anchor socket 80 to a depth of 10 feet. Pile 200 continued to be lowered into pile rock socket 60 during the entire first hole drilling operation until shoulder 246 was in place on the top surface of bedrock 40 at the completion of the second hole drilling step. During these drilling operations, air was continuously passed through air jet 12 to blow the sand away from the outer surface of pipe 200. Drill equipment 50 was then removed and rock anchor socket 80 was prepared to receive a Dywidag-System Grade 150 Bar Rock Anchor 90 having a 1-¾ inch steel rod 96 and an 8 inch diameter bearing plate 100 attached at its distal end in the manner described above in the Detailed Description of the Invention section.

Figure 11:
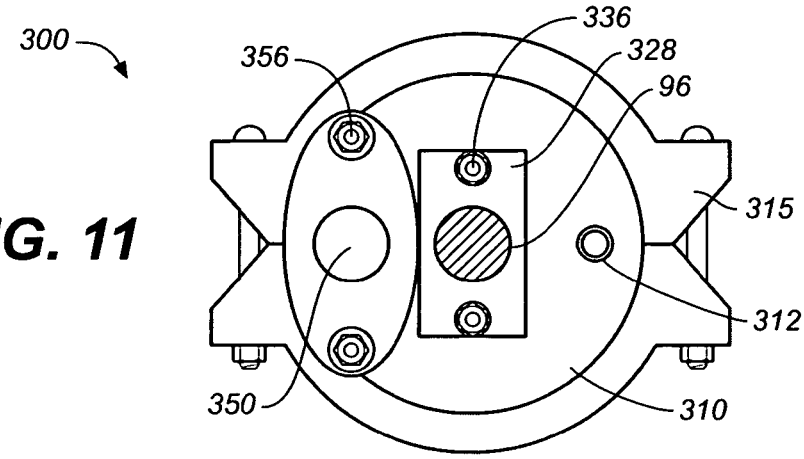
FIG. 11 is a top view of the tremie cap high pressure grout injection system shown in FIG. 10.
Figure 12:
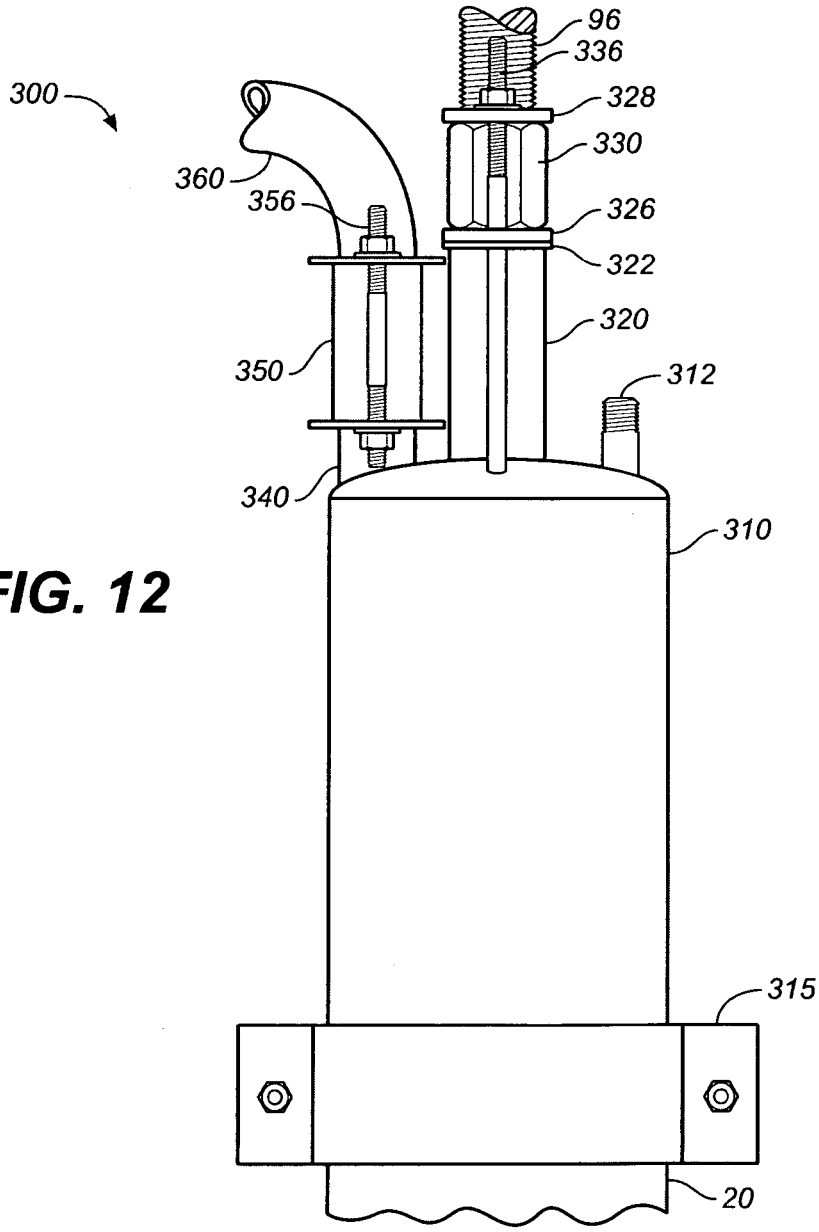
FIG. 12 is a top view of the tremie cap high pressure grout injection system shown in FIG. 10.

During the initial grout injection step, a 2 inch tremie grout injection pipe 104 was lowered into pipe 20 so that outlet 106 was adjacent bearing plate 100 and grout 120 was injected until the grout had filled the interior of second hole and interior of the steel pipe 20. Grout injection pipe 104 was then removed. During the final grout injection step, a tremie cap assembly 300 including tremie cap chamber 310 having a 1 inch vent nipple 312 shown in FIGS. 10-12 was affixed to the top of steel pipe 20 using a 12 inch diameter Type 99 Roust-a-bout Victaulic pipe coupling 315. For this project, a grout nipple connection 340 as shown in FIG. 12 was not used since steel pipe 20 was completely filled with grout before the tremie cap assembly 300 was coupled to the top of pipe 20.

Figure 10:
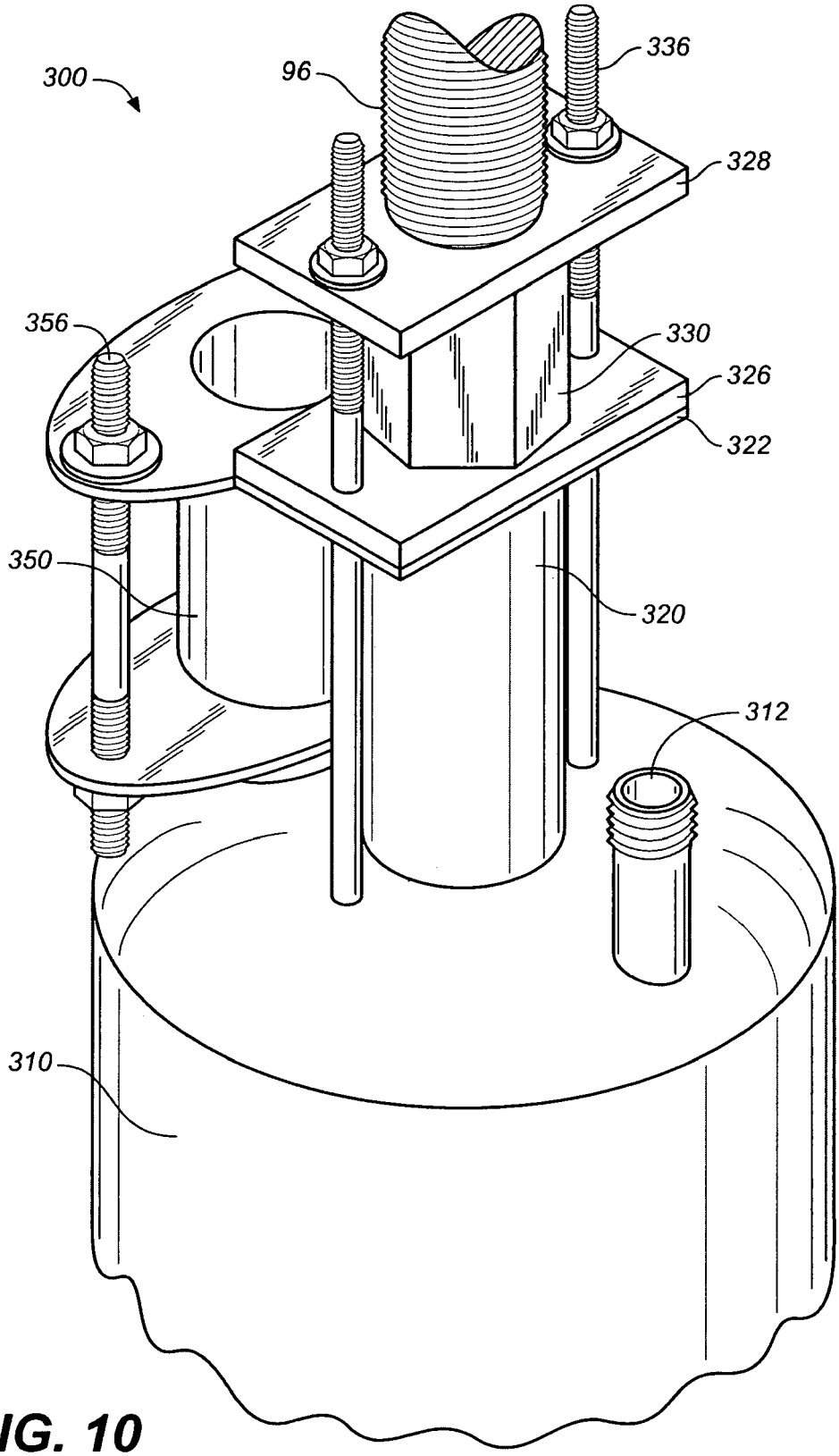
FIG. 10 is an isometric view of the upper portion of a tremie cap high pressure grout injection system used during the grout injecting step of another embodiment of the method of the present invention

Another modification for this Example was that Dywidag rod 96 was extended approximately 12 inches above the top of steel pipe 20 and did not extend up through the Dywidag nipple sleeve 320. Instead, a Dywidag coupling nut, not shown in FIGS. 10-12, was threaded onto the end of the threaded Dywidag rod 96 and a Dywidag rod extension piece was threaded onto the coupling nut to provide the necessary length of rod 96 above the steel pipe 20 as shown in FIGS. 10 and 12. The Dywidag nipple connection 320, although not used for this project, was designed so that the Dywidag rod 96 could extend several feet above the top of steel pipe 20 without the need for a coupling nut and a rod extension piece. The Dywidag nipple connection 320 was designed so that the distal end of a 3 inch diameter Dywidag nipple sleeve 320 for rod 96 was welded to the center of top of chamber 310. A urethane gasket 322 and a ½ inch steel plate 326 were mounted over Dywidag rod 96. Dywidag nut 330 was threaded onto rod 96 and tightened so that steel plate and gasket 322 were brought to bear against top of nipple 320 providing a sealed connection. Another ½ inch plate 328 encircled the extension of rod 96 and mounted onto the top of nut 330. A washer and a nut was tightened onto each of a pair of ½ inch threaded rods 336 to secure rod assembly 96. The grout nipple connection, although not used for this project, was designed so that the distal end of a 2-½ inch grout nipple 340 was welded to the outer circumference of the top of chamber 310. A Smith-Blair steel pipe coupling 350 was used to connect the proximate end of nipple 340 to grout pipe 360 that was connected to the source of grout (not shown). A washer and a nut were tightened onto each of a pair of ⅝ inch threaded rods 356 to secure coupling 350 in place.

Once the tremie cap assembly 300 was secured onto steel pipe 20, an air hose was attached to the vent nipple 312 to feed compressed air into the tremie cap assembly 300. The tremie cap chamber 310 was pressurized to 125 psi for 5 minutes to force the fluid grout through the orifices 34 into the lower portion 30 of steel pipe 20 and into the annular space 64 between the steel pipe and the area of the first hole 60. The tremie cap assembly 300 was removed and the change in the level of grout at the top of steel pipe 20 was measured after pressurizing to determine the volume of grout placed into annular space 64 and to assure that space had been filled with grout. After the grout injection step, the grout was allowed to hardened. The resulting installation was then tested in situ by stressing the rock anchor to 70% of its rated capacity or approximately 285 kips.

Without departing from the spirit and scope of this invention, one of ordinary skill in the art can make various changes and modifications to the method and resulting installed pile of the present invention to adapt it to various usages and conditions. As such, these changes and modifications are properly, equitably, and intended to be, within the full range of equivalents of the following claims.

What is claimed is:

1. A method of installing a concrete pile reinforced with an internal steel pipe comprising the steps of:

a) locating a pre-stressed concrete pile on bedrock that is pre-cast with the steel pipe positioned axially within said concrete pile, the lower end of said steel pipe extending below the concrete pile and having a plurality of orifices therein;

b) drilling a first hole from within the steel pipe into the bedrock to a depth to accept the lower end of the pipe and to a diameter greater than the outer circumference of the steel pipe;

c) drilling a second hole from within the steel pipe into the bedrock so that it is concentric with and below said first hole to form an anchoring socket, said second hole having a smaller diameter than the diameter of said first hole;

d) placing an anchor through the steel pipe and into the anchoring socket for anchoring said anchor to bedrock; and e) injecting a grout under pressure into said steel pile and anchoring socket until the grout fills the steel pipe and said second hole and seeps through the orifices in the lower end of said steel pipe and fills an annular space between the outer circumference of said steel pipe and the bedrock walls of the first hole.

2. The method of claim 1 wherein a drilling device having a retractable bit is lowered through the steel pipe after step (a) and the bit unfurls when it exits the bottom of the steel pipe.

3. The method of claim 2 wherein the depth of said first hole is at least about 5 feet.

4. The method of claim 3 wherein the depth of said first hole is in the range of about 5 to about 25 feet.

5. The method of claim 4 wherein the depth of said second hole is in the range of about 5 to about 25 feet.

6. The method of claim 5 wherein the diameter of said first hole is in the range of about 6 to about 30 inches.

7. The method of claim 6 wherein the diameter of said second hole into the bedrock is in the range of about 3 to about 24 inches and approximately one half the diameter of said first hole.

8. The method of claim 3 wherein the depth of said second hole is at least about 5 feet.

9. The method of claim 8 wherein the diameter of said first hole is at least about 6 inches.

10. The method of claim 9 wherein the diameter of said second hole is at least 3 inches.

11. A method of installing a concrete pile reinforced with an internal steel pipe comprising the steps of:

a) locating a pre-stressed concrete pile on bedrock that is pre-cast with the steel pipe positioned axially within said concrete pile, the lower end of said steel pipe extending below the concrete pile and having a plurality of orifices therein;

b) lowering a drilling device having a retractable bit through the steel pipe and the bit unfurls when it exits the bottom of the steel pipe to permit the drilling of a hole having a diameter greater than the outer circumference of the steel pipe;

c) drilling a first hole using said drilling device into the bedrock to a depth in the range of about 5 to about 25 feet to accept the lower end of the pipe and to a diameter greater than the outer circumference of the steel pipe;

d) drilling a second hole into the bedrock to a depth in the range of about 5 to about 25 feet and less than the depth of said first hole so that it is concentric with and below said first hole to form an anchoring socket, said second hole having a smaller diameter than the diameter of said first hole;

e) placing a rock anchor through substantially the entire length of said steel pipe and into said anchoring socket;

f) extending a grout injection pipe to said second hole;

g) injecting a grout under pressure through said injection pipe until the grout fills the steel pipe and anchoring socket and said second hole and seeps through the orifices in the lower end of said steel pipe and fills an annular space between the outer circumference of said steel pipe and the bedrock walls of the first hole; and h) removing the injection pipe from said pile before allowing the grout to harden.

12. The method of claim 11 wherein the diameter of said second hole into the bedrock is in the range of about 3 to about 24 inches and approximately one half the diameter of said first hole.

13. The method of claim 11 wherein said concrete pile has an octagonal shape and has a nominal diameter of at least about 16 inches.

14. The method of claim 13 wherein said octagonal pile has a nominal diameter in the range of about 16 inches to 40 inches.

15. The method of claim 11 wherein said rock anchor includes a bearing plate at the bottom of said second hole, at the distal end of said rock anchor and adjacent the bottom of said second hole.

16. The method of claim 15 wherein said rock anchor has a diameter of at least one inch.

17. A steel pipe-reinforced concrete pile comprising:

a) a pre-stressed concrete pile having its distal end located on bedrock;

b) a steel pipe pre-cast along the same longitudinal axis as said concrete pile and having a lower portion containing a plurality of orifices and extending below the distal end of said concrete pile and into a first hole drilled into bedrock to leave an annular space between the outer circumference of said steel pipe and the bedrock;

c) an anchor extending through both ends of said steel pipe and into a second hole drilled into the bedrock, said second hole having a diameter that is less than the diameter of said first hole and concentric and below the first hole; and d) grout filling the annular spaces between said anchor and the interior walls of said steel pipe, said anchor and the walls of said second hole, and the outer circumference of said steel pipe and the walls of the first hole.

18. The concrete pile of claim 17 further comprising a bearing plate at the distal end of said rock anchor adjacent the bottom of said second hole.

19. The concrete pile of claim 17 wherein said concrete pile has an octagonal shape and has a nominal diameter of at least about 16 inches.

20. The concrete pile of claim 19 wherein said octagonal pile has a nominal diameter in the range of about 16 inches to 40 inches.

* * * * *